US011657664B2

(12) United States Patent
McKay, Jr.

(10) Patent No.: US 11,657,664 B2
(45) Date of Patent: May 23, 2023

(54) KEYLESS COURIER ENTRY FOR SAFES

(71) Applicant: American Security Products Co., Fontana, CA (US)

(72) Inventor: Donald Ray McKay, Jr., Wylie, TX (US)

(73) Assignee: AMERICAN SECURITY PRODUCTS CO., Fontana, CA (US)

( * ) Notice: Subject to any disclaimer, the term of this patent is extended or adjusted under 35 U.S.C. 154(b) by 0 days.

(21) Appl. No.: 17/669,137

(22) Filed: Feb. 10, 2022

(65) Prior Publication Data

US 2022/0254211 A1 Aug. 11, 2022

Related U.S. Application Data

(60) Provisional application No. 63/148,102, filed on Feb. 10, 2021.

(51) Int. Cl.
*G07C 9/23* (2020.01)
*G07C 9/00* (2020.01)

(52) U.S. Cl.
CPC ..... *G07C 9/23* (2020.01); *G07C 9/00309* (2013.01); *G07C 9/00912* (2013.01); *G07C 2009/00428* (2013.01); *G07C 2009/00769* (2013.01); *G07C 2209/64* (2013.01)

(58) Field of Classification Search
CPC .. G07C 9/23; G07C 9/00309; G07C 9/00912; G07C 2009/00428; G07C 2009/00769; G07C 2209/64
USPC ..... 340/5.54, 5.7
See application file for complete search history.

(56) References Cited

U.S. PATENT DOCUMENTS 6,897,767 B2 5/2005 Kim
6,900,720 B2 * 5/2005 Denison ..... G07C 9/00817 340/10.2
8,797,138 B2 * 8/2014 Myers ..... G07C 9/00571 340/5.7
9,109,379 B1 8/2015 Ranchod
9,504,344 B2 11/2016 Sarvestani
9,619,953 B2 4/2017 Ranchod
9,672,672 B2 6/2017 Ranchod
9,818,247 B2 * 11/2017 Johnson ..... G07C 9/23
(Continued)

FOREIGN PATENT DOCUMENTS

WO WO-2018128755 A1 * 7/2018 ..... G06F 21/34

*Primary Examiner* — Nam V Nguyen
(74) *Attorney, Agent, or Firm* — Socal IP Law Group LLP; Angelo Gaz; Steven C. Sereboff

(57) ABSTRACT

There are disclosed devices, systems and methods for keyless courier entry into a safe using a courier mobile computing device for receiving and authenticating a courier login and a selection for keyless courier entry into the safe. The safe has a computing device for receiving and authenticating a selection for keyless courier entry into the safe. Upon receiving the authenticated selection for keyless entry, the safe computing device generates and displays a factor code based on a safe's serial number. The courier inputs the factor code into the mobile device. In response to receiving and authenticating of the factor code, the mobile computing device generates and displays a security check code. The courier enters the security check code into the safe computing device, which in response to the entry and upon authenticating the security check code, unlocks the safe.

23 Claims, 4 Drawing Sheets

300 Process flow

© 2022 American Security Products Company

(56) References Cited

U.S. PATENT DOCUMENTS

| | | | | |
|---|---|---|---|---|
| 9,830,757 | B2 * | 11/2017 | Weicker | G07C 9/23 |
| 10,614,650 | B2 * | 4/2020 | Minsley | G07C 9/00571 |
| 10,755,510 | B2 * | 8/2020 | Baumgarte | G07C 9/27 |
| 10,771,975 | B2 * | 9/2020 | Conrad | H04W 12/06 |
| 10,915,856 | B2 * | 2/2021 | Fee | G06Q 10/087 |
| 11,430,280 | B2 * | 8/2022 | Jang | E05B 49/00 |
| 2004/0025039 | A1 * | 2/2004 | Kuenzi | G07C 9/00309 713/193 |
| 2005/0088279 | A1 * | 4/2005 | Denison | G07C 9/00309 340/5.23 |
| 2013/0335193 | A1 | 12/2013 | Hanson et al. | |
| 2014/0258168 | A1 * | 9/2014 | Crawford | G06Q 10/0836 705/339 |
| 2016/0267248 | A1 * | 9/2016 | High | G16H 40/20 |
| 2020/0229596 | A1 | 7/2020 | Finney et al. | |

* cited by examiner

© 2022 American Security Products Company

200 Data Flows

© 2022 American Security Products Company

300 Process flow

© 2022 American Security Products Company

400

© 2022 American Security Products Company

KEYLESS COURIER ENTRY FOR SAFES

RELATED APPLICATION INFORMATION

This patent application claims priority from U.S. Provisional Patent Application No. 63/148,102, filed Feb. 10, 2021, titled "Keyless Courier Entry for Safes", the contents of which are expressly incorporated herein.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to keyless courier entry into safes.

Description of the Related Art

Safe systems have evolved from simple drop box technology to drop safe systems where a merchant makes a monetary deposit into a safe that counts the cash as it is deposited into the safe. A courier is dispatched on a schedule to retrieve the deposit, and transport the deposit to a third party such as a bank. The bank sends a confirmation to the merchant that the deposit is at the bank.

Couriers usually open the safes using a physical key, such as a metal key or an electronic key (e.g., key card). Physical keys are easily lost, and electronic keys can be deactivated over time. Also, the assignment and movement of physical courier keys has been a hinderance to allowing retailers to quickly change courier services in the past. As the number of couriers for a retailer or courier services platform grows, it is more difficult for the retailer to switch among the courier service providers. Couriers and retailers currently pay $18-$36 for each physical key that is lost or broken, plus shipping costs. They must also coordinate with the safe manufacturer and the courier service to get a replacement key into the field.

A safe manufacturer's retailer for a certain commercial safe may place over 2,300 orders for courier physical key replacements over a three year period with a cost above $70,000 to the retailer. This cost does not account for the logistics involved with coordinating the courier physical key delivery, reconciling the missing deposits that were left in the unopened safe, or coordinating a new courier pick-up for the location.

In addition, the number of orders for courier physical key replacements grows as the number of safes grows for the retailer. The number of safes in such retail establishments may grow significantly over 2 years and it is estimated that some safe manufacturers have certain types of commercial safes in about 3,500 of the retailers locations. Consequently, safe manufacturers, retailers and courier services desire a solution to these physical key problems.

Throughout this description, elements appearing in figures are assigned three-digit reference designators, where the most significant digit is the figure number where the element is introduced and the two least significant digits are specific to the element. An element that is not described in conjunction with a figure may be presumed to have the same characteristics and function as a previously-described element having the same reference designator.

DETAILED DESCRIPTION

Technologies described herein provide systems and methods for keyless courier entry into safes. The applied for technology includes a feature that will allow couriers to use a mobile computing device such as an android (or other cell phone or mobile) application to generate a one-time access code or security check code to open a customer cash safe door in conjunction with the customer location where the courier services the safe. The customer may be a customer of the safe manufacturer such as a retailer or merchant. The courier may collect money from and deposit change into the money safe of a commercial customer, such as a clothing retailer, restaurant or coffee shop. The application may have mobile device computer programming code with software that mirrors the safe computer programming security check or access code (e.g., safe authentication, QR code generation and access control). It is not necessary for the mobile or safe computing device to be connected to a network, the Internet, a server, or the cloud while generating the security check code. The mobile and safe computing device may be periodically updated so that they are mirrored during an overlapping period, thus allowing each to provide coordinated codes for entry into the safe.

Keyless courier entry into safes provides easy assignment and movement of keyless courier entry into safes allowing retailers to quickly change courier services. Using keyless courier entry into safes also moots the need for courier services and retailers currently to: pay for each physical key that is lost or broken, plus shipping costs; coordinate with the safe manufacturer and the courier to get a replacement key into the field; and perform the logistics involved with coordinating the courier physical key delivery, reconciling the missing deposits that were left in the unopened safe, or coordinating a new courier pick-up for the location.

Description of Apparatus

Figure 1:
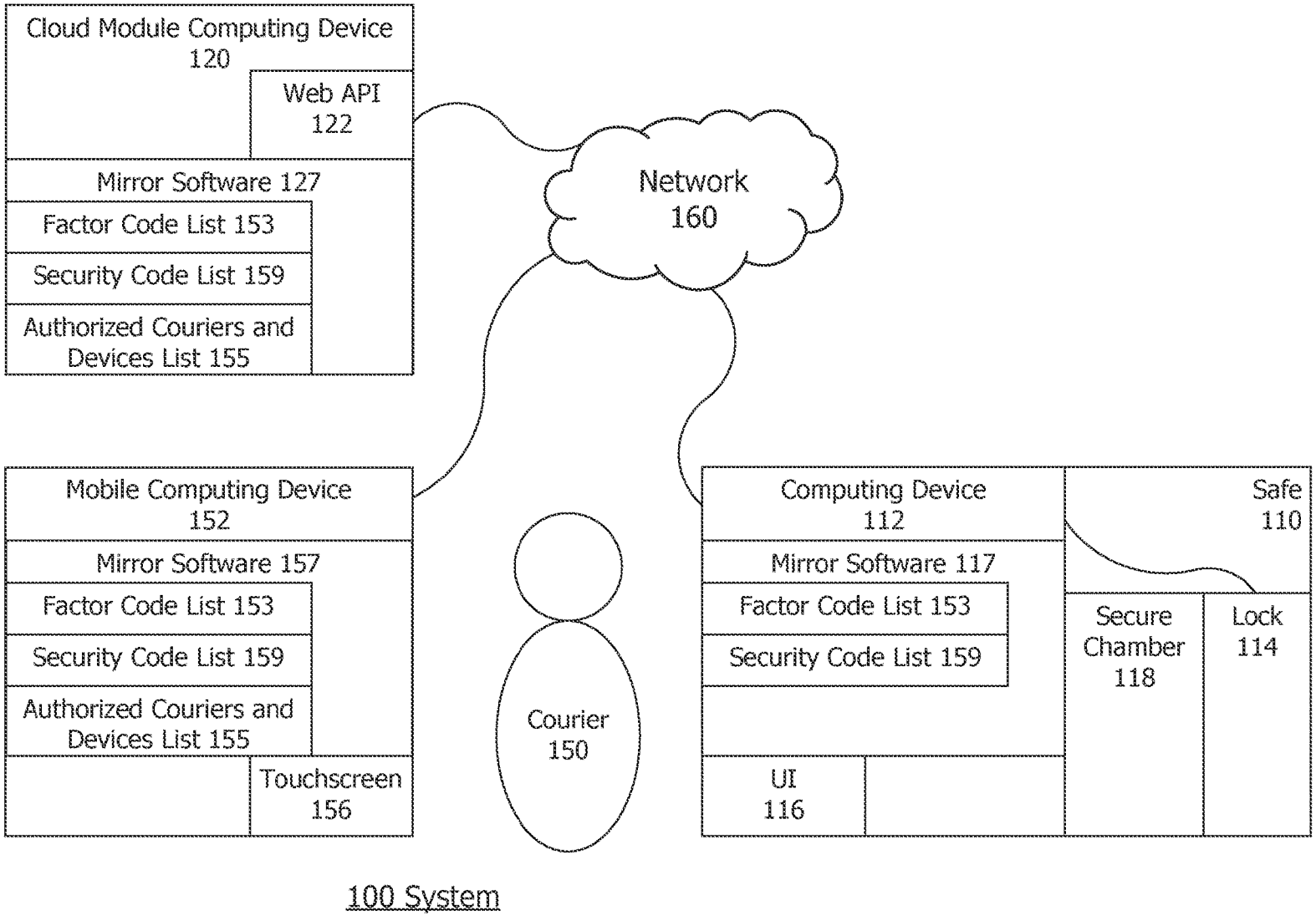
FIG. 1 is a system for keyless courier entry into safes.

Referring now to FIG. 1, there is shown a system 100 for keyless courier entry into a safe 110, such as by courier 150 using mobile computing device 152. The system 100 includes the following system components: the safe 110 having a safe computing device 112 and a lock 114, cloud module computing device 120, the courier 150, mobile computing device 152 and the network 160. Each of the components includes a computing device such as computing device 400 of FIG. 4. Each of these computing devices is connected to the network 160 through a data connection as shown by the lines between each component and the network 160. Computing device 112 is connected to the lock 114 through a data connection as shown by the line between them. The safe and mobile computing devices may communicate with (e.g., transfer data to and from) the cloud module computing device 120 through the network 160. The system 100 may include additional components that are not shown.

The safe 110 may be a smart drop box of a merchant or customer that is used by a courier to perform keyless courier entry into the safe. The safe 110 may be a safe located at a business such as a merchant's store selling goods and/or services. Such stores include a market, specialty retail store, restaurant, bar, clothing store, gym, gas station, coffee shop, furniture store, supermarket, movie theatre, bank, hotel, casino and the like. The safe 110 may also be located at a government facility (e.g., U.S. Navy commissary), educational facility (e.g., a high school cafeteria or merchandise shop), and the like. The safe 110 is a smart (e.g., computer communication enabled by safe computing device 112) drop safe that such a business uses to deposit money that will be collected by courier 150.

The safe 110 includes secure chamber 118 for receiving and a lock 114 for securing money, such as cash and coins. Chamber 188 is a physical storage chamber, container, cassette, cartridge or box that during various periods of time includes or stores items such as money (not shown in FIG. 1). The chamber 118 may be secure by only being accessible to a person having permission to open the lock 114 which secures the chamber.

The safe 110 also includes lock 114 attached to or as part of secure chamber 118. The lock 114 secures the items within the chamber 118 such that they can only be accessed by a person having permission to access the chamber such as by having a physical key or a keyless courier entry authorized to open the lock 114. The lock can be unlocked by safe computing device 112 to provide entry to the chamber 118 upon to authenticate the security check code. The lock can be relocked by the device 112, courier 150 or the merchant. Relocking the safe will cause the factor code and security check code to become unauthorized.

The safe 110 includes the safe computing device 112 having mirror software 117 and user interface (UI) 116. Safe computing device 112 may perform or be part of performing a keyless courier entry into the safe 110. Safe computing device 112 is coupled and controls opening or unlocking of (and optionally the closing or locking of) the lock 114. Safe 110 may be a smart safe with firmware and/or computer code including the mirror software 117 to perform keyless courier entry into the safe 110.

Mirror software 117 may include a factor code list 153 having or accessing corresponding authorized factor codes for safes including safe 110 that are authorized to be entered by the courier based on the selection at step 340.

Mirror software 117 may include a security check code list 159 having authorized factor codes and corresponding security check codes for safes including safe 110 that are authorized to be entered by the courier based on the entered factor code at step 360.

Mirror software 117 may include the same list 153 and list 159 (and optionally list 155, safe serial numbers, factor codes and security check codes) as the mirror software 157 and 127. Software 117 is periodically updated to mirror or have the same list 153 and list 159 (and optionally list 155, safe serial numbers, factor codes and security check codes) as the mirror software 157 and 127, such as by being updated from software 127.

Safe computing device 112 is configured for using a user interface (UI) 116 to receive and authenticate a safe login including the user (e.g., merchant or safe customer) identification and the password. This safe login may use a different user identification and password than the mobile computing device login. This safe login may use a manager login with a 2 digit username and a 6 digit password combined into an 8 digit sequence. In some cases, characters may replace some or all of the digits. The safe login may also be or include a key fob device login. In some cases, it includes both the 8 digit sequence and fob device login. Authenticating the safe login may be required to display the factor code and to authenticate the security check code.

Safe computing device 112 is configured for generating a factor code including by: receiving and authenticating a safe login from the merchant; receiving a safe selection from the courier for keyless courier entry into the safe 110; generating and displaying a factor code in response to authenticating the courier 150 and receiving the selection; receiving from the courier and authenticating a security check code; and opening the lock 114 and secure chamber 118 upon authenticating the security check code.

During the time period of receiving and authenticating the safe login through generating a factor code, the safe computing device 112 does not need to be and may not be connected to a computer network 160. During this time period, the safe computing device 112 may not be connected to or communicating with a computer network, the Internet, a server, the cloud, WiFi or Blue Tooth.

UI 116 may be an input/output device to receive inputs by a courier 150, a manager of the safe, a retailer. UI 116 may receive inputs by fingerprint, face recognition, voice recognition, voice command, keyboard entry, touchscreen entry, barcode scan, etc. It may provide output by display screen, printer, touchscreen, barcode display, etc. UI 116 may be an LCD display and touchpad combination.

Cloud module computing device 120 includes mirror software 127 and web application program interface (API) 122 for communicating with device 152 and 112. Cloud module computing device 120 may be a cloud module having courier administrative capabilities that can handle mobile device 152 and safe device 112 registration. It may be one or more servers and/or clouds. It may also handle merchant registration and login at safe device 112. It may also handle courier registration and login at mobile device 152 and safe device 112. It may also handle safe device 152 and courier device 152 configuration.

Web API 122 may be one or more web APIs hosted on cloud module computing device 120 which is used by the mobile device 152 to perform functions of the cloud module computing device 120.

Mirror software 127 may include a factor code list 153 having or accessing identifications of authorized couriers and mobile devices list 155 and corresponding authorized factor codes for safes including safe 110 that are authorized to be entered by the courier based on the identification of couriers and mobile devices in the authenticated identification of the courier and mobile device at step 310 and/or selection at step 340.

Mirror software 127 may include a mobile device security check code list 159 having authorized factor codes and corresponding security check codes for safes including safe 110 that are authorized to be entered by the courier based on the entered factor code at step 360.

Mirror software 127 may include the same list 153 and list 159 (and optionally list 155, safe serial numbers, factor codes and security check codes) as the mirror software 157 and 117. Software 127 mirrors or has the same list 153 and list 159 (and optionally list 155, safe serial numbers, factor codes and security check codes) as the mirror software 157 and 117, such as by being used to update software 157 and 117.

Software 127 may be used to periodically updated mirror software 117 and mobile device mirror software 157. At some period in time, such as during keyless courier entry into the safe 110, each of mirror software 117, 127 and 157 may be the same or have the same list 153 and list 159 (and optionally list 155, safe serial numbers, factor codes and security check codes).

Courier 150 may be part of performing a keyless courier entry into the safe 110. The courier 150 may be an agent or employee hired by the merchant or the merchant's bank to retrieve deposits made to safe 110 and deliver the retrieved deposits to the bank. The courier 150 may be a person employed by, hired by, contracted by, or otherwise controlled by the bank. It is also considered that the courier 150 may actually be the merchant, safe owner or an agent thereof who will perform keyless entry to put money in the safe, take money out of the safe, confirm contents of the safe, inventory the safe contents, make change to or from the money in the safe, etc.

The courier 150 may possess and use mobile computing device 152 to perform keyless courier entry into the safe 110. Mobile computing device 152 may perform or be part of performing a keyless courier entry into the safe 110. The device 152 includes mirror software 157 and touchscreen 156.

Mobile computing device 152 is configured for using touchscreen 156 to receive and authenticate a mobile device login including the courier identification and the password. Authenticating the mobile device login is required to display the security check code based on authenticating the factor code.

Mobile computing device 152 is configured for generating a security check code including by: receiving and authenticating a mobile computing device login from a courier; receiving a mobile computing device selection from the courier for keyless courier entry into the safe; receiving and authenticating a factor code input by the courier (by scanning or manually input); in response to authenticating the factor code (optionally also in response to receiving a courier mobile computing device courier login authentication and receiving the selection for keyless entry) generating and displaying the security check code for entry into the safe by the courier.

During the time period of selection from the courier for keyless courier entry into the safe through generating a security check code, the mobile computing device 152 does not need to be and may not be connected to a computer network 160. During this time period of, the safe computing device 112 may not be connected to or communicating with a computer network, the Internet, a server, the cloud, WiFi or Blue Tooth. During receiving and authenticating the mobile device login, the mobile computing device 152 may be connected to a computer network 160

Mirror software 157 may include a factor code list 153 having or accessing identifications of authorized couriers and mobile devices list 155 and corresponding authorized factor codes for safes including safe 110 that are authorized to be entered by the courier based on the identification of couriers and mobile devices in the authenticated identification of the courier and mobile device at step 310 and/or selection at step 340.

Mirror software 157 may include a security check code list 159 having authorized factor codes and corresponding security check codes for safes including safe 110 that are authorized to be entered by the courier based on the entered factor code at step 360.

Mirror software 157 may include the same list 153 and list 159 (and optionally list 155, safe serial numbers, factor codes and security check codes) as the mirror software 117 and 127. Software 157 is periodically updated to mirror or have the same list 153 and list 159 (and optionally list 155, safe serial numbers, factor codes and security check codes) as the mirror software 117 and 127, such as by being updated from software 127.

Touchscreen 156 may be an input/output device to receive inputs by a courier 150. Touchscreen 156 may receive inputs by fingerprint, face recognition, voice recognition, voice command, keyboard entry, touchscreen entry, barcode scan, etc. It may provide output by display screen, printer, touchscreen, barcode display, etc.

Device 152 may be a smart phone, pad computer, laptop computer or other mobile computing device with firmware and/or computer code including the mirror software 157 to perform keyless courier entry into the safe 110.

The mobile device 152 may be or include a mobile device application having computer instructions that perform the functions described as being performed by mobile computing device 152, such as where there are a number of applications running on the mobile computing device 152 that perform other functions that are not the keyless courier entry functions described herein.

Figure 4:
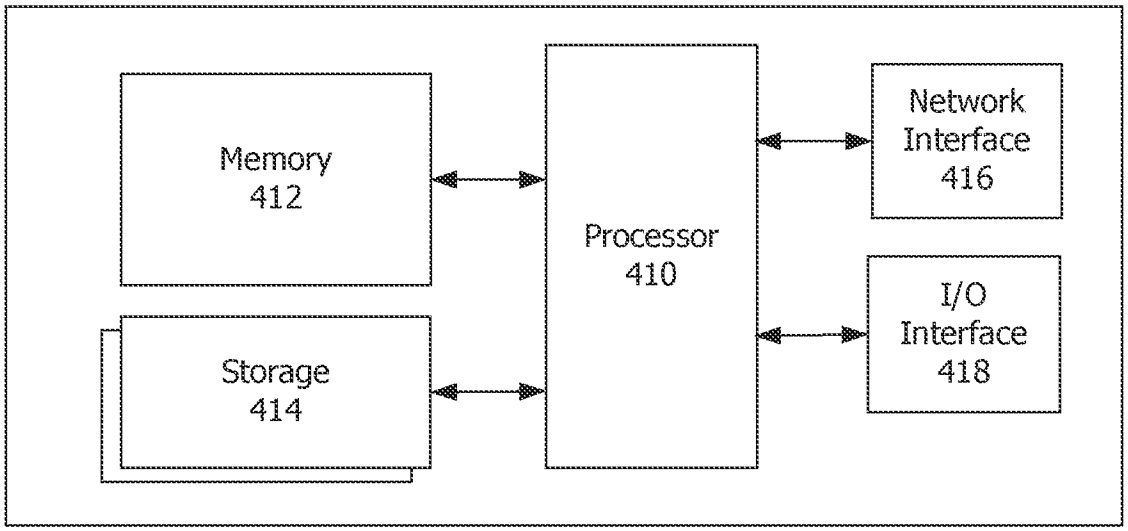
FIG. 4 is a block diagram of a computing device.

Each of computing devices 112, 120 and 152 may have all or some of the processor 410, memory 412, storage 414, network interface 416 and/or I/O interface 418 of computing device 400 of FIG. 4. Notably, each may have the network interface 416 for communication through data connection with the network 160 and with other components of the system 100. Also, each may have the I/O interface 418 for transmitting or receiving mirror software as noted herein. Moreover, each may have the I/O interface 418 for informing, reporting and/or confirming to a merchant, device 120 and/or courier the performance of keyless courier entry into safe 110.

The network 160 may be a network that can be used to communicate as noted for the network attached to computing device 400 of FIG. 4. Each of the computing devices 112, 120 and 152 is connected to the network 160 through a data connection to send or receive mirror software to or from other components of system 100 as noted herein. Each data connection may be or include network: connections, communication channels, routers, switches, nodes, hardware, software, wired connections, wireless connections and/or the like. Each data connection may be capable of being used to communicate network packets, network messages, telephone calls, faxes, signals, streams, arrays, selection information 117 and/or confirmation 180 as described herein.

Description of Processes

Figure 2:
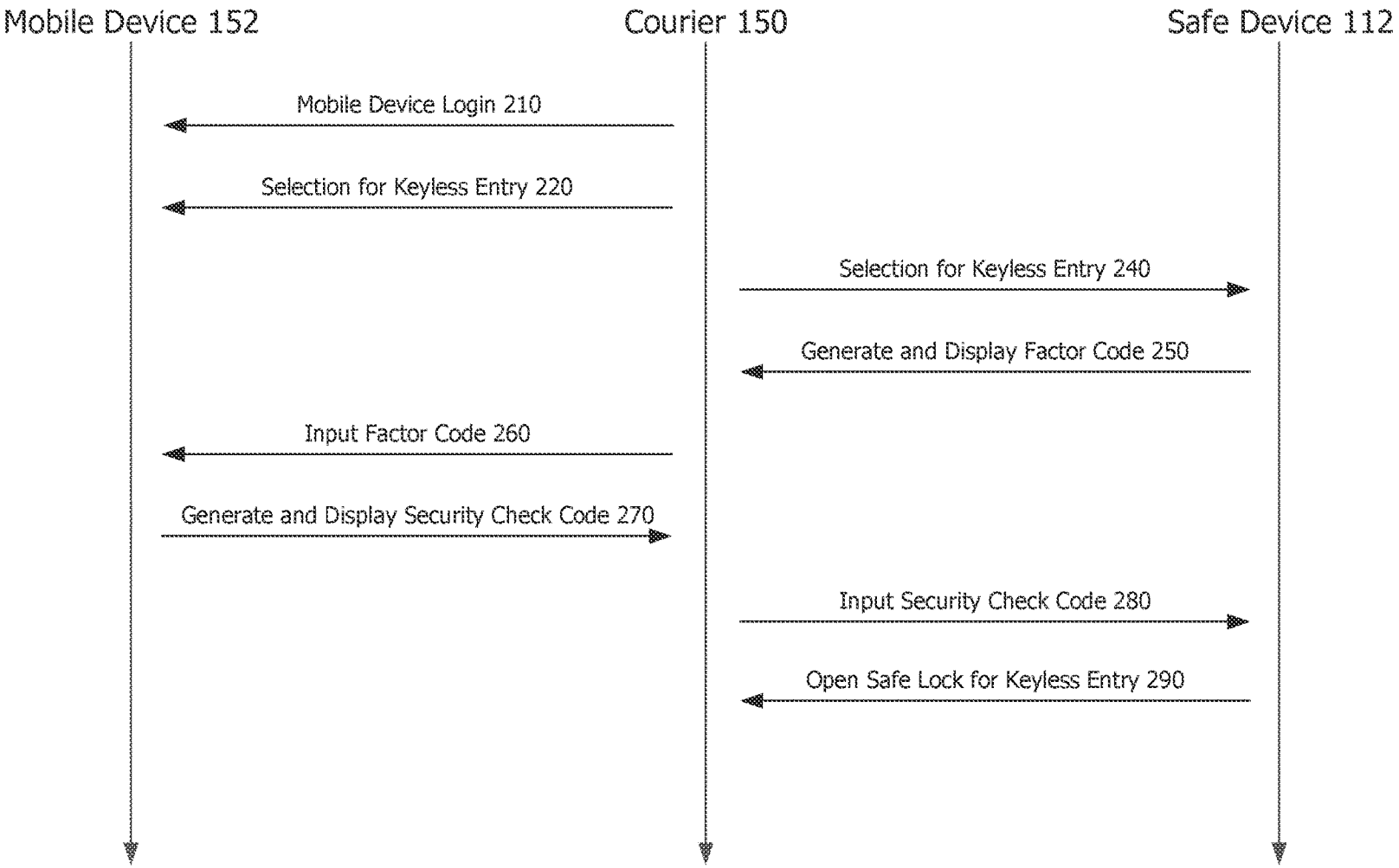
FIG. 2 show data flows for keyless courier entry into safes.

FIG. 2 show data flow 200 for keyless courier entry into safes. Data flows 200 include sequence of data flows 210-290 between mobile device 152, courier 150 and safe computing device 112. Data flows 210-240, 260 and 280 may result from and/or include an input to a computing device 112 or 152 by the courier 150. Data flows 250, 270 and 290 result from and/or include an output by a computing device 112 or 152 to the courier 150. Flow 290 may be a data flow to lock 114 of safe 110 which is evidenced to courier 150 by the unlocking of the lock 114.

Data flow 210 is a courier login input to mobile device 152. This login input includes a user (e.g., courier) identification and a user password. It may also include identification of the mobile device 152.

Data flow 220 is a courier input selection to mobile device 152 for keyless entry to the safe 110. This input selection may include the courier scanning with device 152 or manually entering into device 152 a serial number of the safe. The serial number may be a manufacturer's serial number of the save or another unique identification of the safe. Making this input selection may require prior successful authentication of the login at data flow 210.

In some cases, data flow 240 occurs before data flow 210. In some cases, data flow 240 can occur after step 210 and before data flow 22.

Data flow 240 is a courier input selection to safe device 112 for keyless entry to the safe 110. Making this input selection may require prior successful authentication of the login at data flow 220. In some cases, data flow 240 includes a merchant or safe customer login input to safe computing device 112. This login input includes a user (e.g., merchant) identification and a user password.

Data flow 250 is safe device 112 automatically generating and displaying a factor code for keyless entry to the safe 110 based on the input of the selection of data flow 240. Automatically, may be when a computing device performs the generating and displaying after the prior input noted, without further input to that computing device. The factor code may be based on a known safe's serial number (e.g., that is known by or stored in a memory of the safe) in some cases the factor code includes the safe serial number and an additional 4 digit code. Generating and displaying of data flow 250 may require prior successful courier selection at data flow 240. It may also require authenticated login of the merchant.

Data flow 260 is a courier input to mobile device 152 of the factor code from data flow 250. This input may include the courier scanning a bar code of the factor code with device 152 or manually entering the factor code into device 152. Making this input may require prior successful authentication of the login at data flow 210 and prior successful courier selection at data flow 220.

Data flow 270 is mobile device 152 automatically generating and displaying a security check code based on the input of the factor code at data flow 260. The security check code may be based on the input factor code from data flow 260, identification of the courier from data flow 210, and a serial number from flow 220. Generating and displaying of data flow 270 may require prior successful authentication of the login at data flow 210, prior successful courier selection at data flow 220 and prior successful authentication of the factor code at data flow 260.

Data flow 280 is a courier input to safe device 112 of the security check code from data flow 270. This input may include the courier scanning a display of the device 152 or manually entering the security check code into device 152. Making this input may require prior successful courier selection at data flow 240.

Data flow 290 is safe device 112 automatically opening the lock 114 to accomplish and/or complete keyless entry to the safe 110 based on the input of the security check code of data flow 280. The opening of the lock may be based on security check code of data flow 280, a serial number (e.g., that is known by or stored in a memory of the safe), and identification of the courier from data flow 220. Opening the lock of data flow 290 may require prior successful courier selection at data flow 240.

After data flow 290, lock 114 can be relocked by the device 112, courier 150 or the merchant. Relocking the safe will cause the factor code and security check code to become unauthorized or to reset to new codes and flow 200 may return to data flow 220 or 240.

Figure 3:
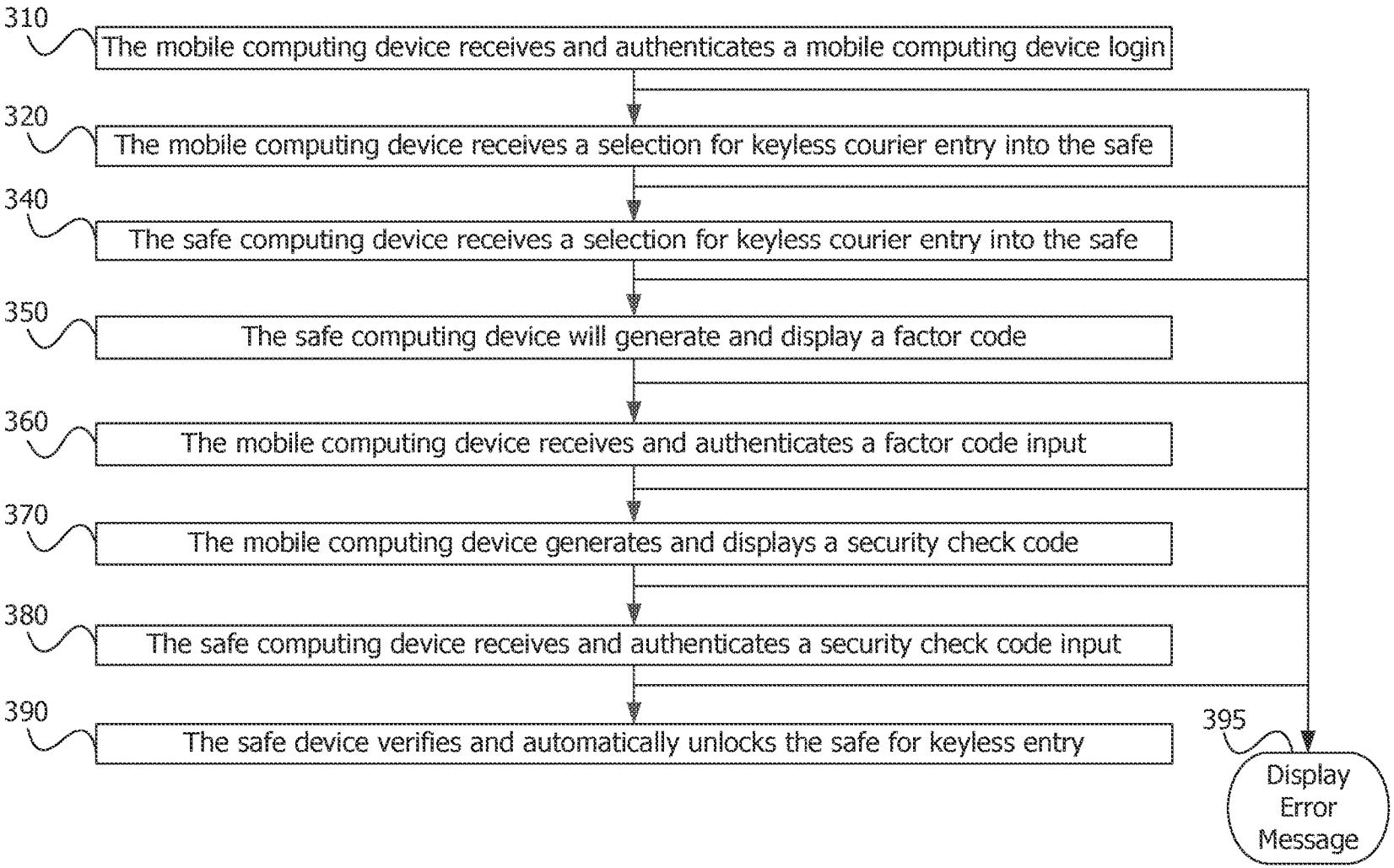
FIG. 3 shows a flow chart of an operating environment/process for keyless courier entry into safes.

FIG. 3 shows a flow chart of an operating environment/process 300 for keyless courier entry into safes. The process 300 starts at step 310 ends at step 390 with a keyless courier entry into a safe or at step 395 with an error message. After step 395 process 300 may return to step 320 or 340. The flow chart of FIG. 3 includes only major process steps. Various conventional steps (e.g., the typing of characters, input of an "enter" character, updating login user identification and/or password, registration and download/update of the computing devices 112 and 152: courier identification, mobile device identification, safe serial number, factor codes, security check codes, etc.) may be performed before the steps shown in FIG. 3.

The process 300 starts at step 310 where mobile computing device 152 receives and authenticates a mobile computing device login including a user identification and a password, input to touch screen 156 by courier 150. Step 310 may be the courier inputting the mobile computing device login to a mobile application of device 152 and device 152 authenticating the login the using a network or the internet coupled to cloud device 120, such as through web API 122. Step 310 may include data flow 210.

The mobile device login may be authenticated if the user identification and a password are valid or registered at the cloud device 120 or optionally are registered at mirror software 127. Authenticating at step 310 may include comparing the mobile device input user identification and password to a mobile device login list and authenticating the mobile computing device login if the mobile device input user identification and password are on the mobile device login list. In addition, the login at step 310 may be authenticated if the device 152 identification is valid or registered at the cloud device 120 or optionally at mirror software 127, such as by being on a device login list.

The mobile device login list may be authorized courier and devices list 155 that is part of mirror software 157. The user identification, mobile device identification and password on the mobile device login list may authorize only one single courier for only one single mobile device.

Authenticating at step 310 may include that if the mobile computing device login is authenticated, the mobile computing device 152 generating an authenticated identification of the courier and optionally an identification of the mobile computing device that may be used at step 370.

Step 310 may include the courier 150 opening a new application on their mobile computing device 152, such as by logging in to the application on the mobile device and the login may be good for a period of time such as 24 hours.

Authenticating at step 310 may include that if the mobile computing device login is authenticated, the mobile computing device 152 updating the mobile mirror software 157. This update may update mobile mirror software 157 to have the same list 153 and list 159 (and optionally list 155, safe serial numbers, factor codes and security check codes) as the safe mirror software 117, such as by updating the software 157 with software 127 of device 120. The mirror software may also be updated periodically after an authenticated mobile computing device login, such as every 3 hours or 24 hours.

Step 310 may include device 152 generating and displaying on the touch screen 156 a mobile computing device login authorization message if the login was authenticated at step 310 or generating a mobile computing device login error message at step 395 if the login was not authenticated at step 310.

At step 320, the mobile computing device 152 receives a mobile computing device selection for keyless courier entry into the safe 110, input to touch screen 156 by courier 150. Step 320 may be the courier inputting the selection to a mobile application of device 152. Step 320 may include data flow 220. Step 320 may include the courier scanning a barcode having the safe serial number or manually entering the safe serial number. This selection requires authentication of the login at step 310.

Step 320 may include that once at the safe location the courier 150 can enter the customer's location into the mobile application on their mobile computing device 152. In optional cases, the courier will scan with their mobile device, a barcode that will be previously placed on the safe; or can manually enter this information into the application. The barcode will have information that corresponds to the safe's serial number (EX: KS00123123). The serial number may be a manufacturers serial number of the safe or other unique identification of the safe.

The safe device login list may be part of mirror software 117. The user identification and password on the safe device login list may be only one single courier and one single safe or safe serial number.

Step 320 may include device 152 generating and displaying on the touch screen 156 a selection for keyless courier entry authorization message if the login was authenticated at step 310 or generating a keyless courier entry error message at step 395 if the login was not authenticated at step 310.

At step 340, the safe computing device 112 receives a safe computing device selection input for keyless courier entry into the safe 110, from UI 116 by courier 150. Step 340 may be the courier manually inputting the selection to UI 116. Step 340 may include data flow 240.

Step 340 may include that the safe customer (e.g., retailer) and/or courier will start the process to open the courier safe door or chamber 118 by making an input to UI 116. At step 340, a "present courier key" menu on the safe UI 116 may be changed to allow selection of keyless courier entry and the keyless entry option may be good for a period of time such as 3-5 minutes. This selection may be the courier entering or pressing a single key of the UI 116.

Step 340 may include device 112 generating and displaying on the UI 116 a selection for keyless courier entry authorization message if the selection and login was authenticated at step 320 or generating a keyless courier entry error message at step 395 if the login was not authenticated at step 320.

Step 340 may optionally include that the safe computing device 112 receives and authenticates a safe computing device login including a user identification and a password, input to UI 116 by the merchant or safe customer. This may be the merchant inputting the safe computing device login to UI 116 and computing device 112 authenticating the login if the user identification and a password are valid or registered at mirror software 117. This may include the corresponding optional description at data flow 240. This safe login may use a manager login with a 2 digit username and a 6 digit password combined into an 8 digit sequence. In some cases, characters may replace some or all of the digits. The safe login may also be or include a key fob device login. In some cases, it includes both the 8 digit sequence and fob device login.

The safe login may be authenticated if the user identification and a password are valid or registered at the safe device 112 or at mirror software 117.

Authenticating at step 340 may include that if the safe computing device login is authenticated, the safe computing device 112 will generate an authenticated identification of the courier that may be used at step 350 and optionally may be used at step 380.

In some cases, the safe mirror software 117 exists or is setup (e.g., as firmware) upon purchase of the safe. For example, the safe can be installed without access to a computer network 160 or the internet and will still perform keyless courier entry. The keyless entry of process 300 may not require the device 112 to be in communication with any other computing device, regardless of the type of communication, such as Internet, wired, wireless, WiFi, Blue tooth, etc. In some cases, the safe is located where no wireless signals exist and is not connected to anything by wired communication. In some cases, the safe mirror software 117 is only updated if an update is requested by merchant or safe customer request. In other cases, the safe mirror software is also be updated periodically, such as every 3 hours or 24 hours. This update may update safe mirror software 117 to have the same list 153 and list 159 (and optionally list 155, safe serial numbers, factor codes and security check codes) as the mobile mirror software 127, such as by updating the software 117 with software 127 of device 120. In some cases, software 117 includes software and/or firmware (e.g., BIOS) on the safe that is updated upon availability of a later release, similar to how apps are updated on a cell phone. Update versions of software 117 may be iterated every 6 weeks or more. Updates to software 117 may be performed at whatever period the network 160 connection cadence is set to, such as every 15 minutes, every hour, etc.

At step 350, upon receiving the selection at step 340, the safe computing device 112 will automatically generate and display on the UI 116 to the courier 150 a factor code based on the safe's known serial number. This known serial number may be known by and stored in a memory of the safe. Step 350 may include data flow 250.

At step 350, upon the selection of step 340, the safe computing device 112 may generate and output on the safe UI 116 a quick response (QR) code (e.g., 4-digit QR code) or factor code (based on the safe's serial number) to be used by the mobile application of mobile computing device 152 to generate the (e.g., 6-digit) open pin number or security check code. In some cases, the factor code is more than 4-digits such as by including the safe serial number as part of the factor code. The safe serial number may be 10 characters. Thus, the factor code may be a combination of the safe serial number and a quick response (QR) code (e.g., 4-digit QR code). The factor code may be 14 characters that are the safe serial number and the QR code.

The safe device 112 generating a factor code may include the safe computing device 112 comparing (e.g., looking up) the safe's known serial number to a factor code list 153 having or accessing authorized safe serial numbers and corresponding authorized factor codes. In some cases, generating a factor code includes comparing the safe's known serial number to a factor code list 153 having corresponding factor codes for safes that are authorized to be keyless entered by a courier based on the known safe serial number.

The factor code list 153 may be part of mirror software 117. The corresponding factor code(s) may be for safes that only one single courier is authorized to enter.

In some cases, if the safe's known serial numbers on the factor code list 153, the safe will access from the factor code list 153, the corresponding factor code of the safe's known serial number. In some cases, if the safe's known serial numbers not on the factor code list 153, the safe will display on the UI 116 an error message at step 395 to the courier indicating that there is no corresponding factor code for the safe's serial number that is authorized to be entered by the courier.

At step 360, the mobile computing device 152 receives and authenticates a factor code input including the factor code of step 350, input to touch screen 156 by courier 150. The factor code from step 350 input at step 360 may include the safe's serial number. Step 360 may be the device 152 receiving the factor code input either by the mobile device reading a QR code or receiving a manual input of the code. Step 360 may be the courier inputting the factor code read or viewed by the courier at step 350, to a mobile application of device 152, and device 152 authenticating the factor code without the using a network or the internet. Step 360 may include data flow 260.

At step 360, the courier 150 may scan with a camera of their mobile device 150, a barcode of the factor code. In other cases, the courier may key into the touch screen 156 the factor code displayed by the safe into the mobile application of the mobile device 152. The factor code corresponds to the safe's serial number, such as noted at step 350.

Authenticating at step 360 may be or include authentication of the login at step 310. Authenticating at step 360 may generate an authenticated factor code.

Step 360 may include device 152 generating and displaying on the touch screen 156 a mobile computing factor code entry authorization message if the login was authenticated at step 310 or generating a mobile computing device factor code entry error message at step 395 if the login was not authenticated at step 310.

At step 370, upon receiving the factor code input at step 360, and upon authentication of the factor code at step 360, the mobile device 152 will automatically generate and display on the touch screen 126 to the courier 150, a security check code to open the safe. Step 370 may include data flow 270.

In some cases, at step 370, the mobile computing device 152 (e.g., running computer instructions) will generate a security check code based on the input factor code, that is displayed by the mobile computing device touch screen 156 to the courier 150. The security check code may be displayed in a way that only the courier 150 can see it. To generate the security check code based on the factor code, the mobile computing device may use computer programming mirror code 157 stored on that device that mirrors the access code mirror software 117 of the safe computing device 112. Both sets of mirror software 157 and 117 may include a timestamp which identifies a period of time for which their codes are valid after receiving the stamp. The stamps may overlap in time creating a period during which the two software are coordinated, and thus able to properly function for keyless opening of the safe, such as by process 300.

The mobile device 152 generating a security check code may include the mobile device 152 comparing (e.g., looking up) the factor code input at step 360 to a mobile device security check code list 159 having authorized factor codes and corresponding security check codes for safes including safe 110. In some cases, generating a security check code includes comparing the authenticated identification of the courier and optionally identification of the mobile device from step 310 and the factor code input at step 360 to a mobile device security check code list 159 having identifications of authorized couriers and optionally of mobile devices for keyless entry, authorized factor codes and corresponding authorized security check codes for safes that are authorized to be entered by the courier based on the authentication at step 310 and the factor code input at step 360. In some cases, factor code may include the safe serial number, and thus the comparison of factor codes includes a comparison of safe serial numbers.

The mobile device security check code list 159 may be part of mirror software 127. The corresponding security check codes may be for safes that only one single courier is authorized to enter. Authenticating at step 370 may generate an authenticated security check code.

In some cases, if the factor code input at step 360 (and optionally the authenticated identification of the courier and mobile device at step 310) is on the security check code list 159, the mobile device 152 will access from the security check code list 159, the corresponding security check of the factor code input at step 360. In some cases, if the factor code input at step 360 (and optionally the authenticated identification of the courier and mobile device at step 310) is not on the security check code list 159, the mobile device 152 will display on the touch screen 156 an error message at step 395 to the courier indicating that there is no corresponding security check code for the safe's serial number that is authorized to be entered by the courier.

At step 380, the safe computing device 112 receives and authenticates (e.g., or verifies as noted at step 390) a security check code input including the security code displayed at step 370, to UI 116 by courier 150 for keyless courier entry into the safe 110. Step 380 may be the courier manually inputting the security check code to UI 116. At step 380, the security check code can be entered or keyed on the screen or buttons of the safe UI 116 by the courier 180. Device 112 may authenticate the security check code without the using a network or the internet. Step 380 may include data flow 280.

The safe computing device 112 authenticating the input security check code may include the safe computing device 112 comparing (e.g., looking up) the input security check code from step 370 to a safe security check code list 159 having authorized security check codes for that safe 110 based on the input security check code input at step 380. In some cases, authenticating the input security check code includes comparing the input security check code from step 370 to a safe security check code list 159 having authorized security check codes, identifications of authorized couriers for keyless entry, safe serial numbers for safes that are authorized to be entered by the courier based on the identification of the courier at step 310 or 240; and the input security check code input at step 370.

The safe security check code list 159 may be part of mirror software 117. In some cases, the corresponding security check codes may be for safes that only one single courier is authorized to enter.

Step 380 may include that if the input security check code is on the security check code list 159, the safe device 112 authenticating or verifying the input security check code, and generating and displaying on the UI 116 a security check code authorization message to the courier. Step 380 may include that if the input security check code is not on the security check code list 159, the safe device 112 displaying on the UI a security check code error message at step 395 to the courier indicating that the input security check code is not authenticated for the safe's serial number to be entered by the courier.

At step 390, upon receiving the security check code at step 380, if the security check code at step 380 is authenticated, the safe device 112 will verify the security check code entered at step 380 and automatically unlock the lock 114 for entry to the chamber 118 by the courier. Step 390 may include data flow 290.

At step 390, when the proper or authorized security check code is input to the safe, the lock 114 will fire, and the courier pick-up process will execute as designed, such as if a physical key had opened the lock 114.

After step 390, lock 114 can be relocked by the device 112, courier 150 or the merchant. Relocking the safe will cause the factor code and security check code to become unauthorized or to reset to new codes and process 300 may return to step 320 or 340.

During steps 320-390 it is not necessary for the safe computing device 112 or the mobile computing device 152 to be connected to a network, the Internet, a server, or the cloud while performing this opening process 300 (e.g., from when the courier enters the location until the pick-up process is completed). However, device 152 may be connected to an API, server or computing cloud through a network or the Internet when the courier logs into the mobile device application at step 310. The mirror software 157 of the mobile computing device may be periodically updated so that it is coordinated or mirrored with mirror software 117, thus allowing these computing devices to output the proper factor codes and security check codes for entry into the safe by process 300. This updating of mirror software 157 may happen every 10 min, hour, hours, day or the like.

That is, the mirror software 117 and 156 may have, for an overlapping period of time, such as during steps 320-390, the same factor code list 153 and security access code list 159. In some cases, the mirror software 117 and 156 may also have, for an overlapping period of time, such as during steps 320-390, the same authorized couriers and devices list 155, factor code list 153 and security access code list 159. In these cases, there may be no distinction in calling them mobile or safe device lists 153 and 159 (and optionally 155) as they are the same lists.

In some cases, step 340 can occur before step 310. In some cases, step 340 can occur after step 310 and before step 320.

Process 300 may include or be split into only certain steps. In one example, only mobile device steps 310, 320, 360 and 370 may be performed in an embodiment that is the actions performed by device 152. In another example, only safe device steps 340, 350, 380 and 390 may be performed in an embodiment that is the actions performed by device 112.

FIG. 4 is a block diagram of a computing device 400. The computing device 400 may be representative of the computing device 112, 120 and/or 152, herein. The computing device 400 may be a desktop or laptop computer, a server computer, a client computer, a network router, a network switch, a network node, a tablet, a smartphone or other mobile device. The computing device 400 may include software and/or hardware for providing functionality and features described herein. The computing device 400 may therefore include one or more of: logic arrays, memories, analog circuits, digital circuits, software, firmware and processors. The hardware and firmware components of the computing device 400 may include various specialized units, circuits, software and interfaces for providing the functionality and features described herein. For example, the components of system 100 may perform a keyless courier entry into safes using the device 152 and/or the safe device 112, such as by keyless courier entry into safe 110.

The computing device 400 has a processor 410 coupled to a memory 412, storage 414, a network interface 416 and an I/O interface 418. The processor 410 may be or include one or more microprocessors, field programmable gate arrays (FPGAs), application specific integrated circuits (ASICs), programmable logic devices (PLDs) and programmable logic arrays (PLAs).

The memory 412 may be or include RAM, ROM, DRAM, SRAM and MRAM, and may include firmware, such as static data or fixed instructions, BIOS, system functions, configuration data, and other routines used during the operation of the computing device 400 and processor 410. The memory 412 also provides a storage area for data and instructions associated with applications and data handled by the processor 410. As used herein the term "memory" corresponds to the memory 412 and explicitly excludes transitory media such as signals or waveforms.

The storage 414 provides non-volatile, bulk or long-term storage of data or instructions in the computing device 400. The storage 414 may take the form of a magnetic or solid state disk, tape, CD, DVD, or other reasonably high capacity addressable or serial storage medium. Multiple storage devices may be provided or available to the computing device 400. Some of these storage devices may be external to the computing device 400, such as network storage or cloud-based storage. As used herein, the terms "storage" and "storage medium" correspond to the storage 414 and explicitly exclude transitory media such as signals or waveforms. In some cases, such as those involving solid state memory devices, the memory 412 and storage 414 may be a single device.

The network interface 416 includes an interface to a network such as a network that can be used to communicate network packets, network messages, telephone calls, faxes, signals, streams, arrays, software 127, 117 and/or 157 as described herein. The network interface 416 may be wired and/or wireless.

The I/O interface 418 interfaces the processor 410 to peripherals (not shown) such as displays, video and still cameras, microphones, user input devices (e.g., touchscreens, mice, keyboards and the like) and USB devices. In some cases, the I/O interface 418 includes the peripherals, such as displays and user input devices, for being accessed by the merchant and/or courier 150 to perform any of the actions noted in FIGS. 1-3.

The device 400 may have as lock similar to lock 114 that secures access to the device 400 or the capability to use the I/O interface 418 so that the device 400 can only be accessed by a person having a physical key or keyless courier entry. For example, a lock of the device 400 may allow access to the device 400 during various periods of time by the merchant and/or courier 150 who has permission, such as by using keyless courier entry into safes. The device 400 may include additional components.

In some cases, storage 414 is a non-volatile machine-readable storage medium that includes all types of computer readable media, including magnetic storage media, optical storage media, and solid state storage media. It should be understood that the software can be installed in and sold with the safe 110, the device 112, the device 120 and/or the device 152. Alternatively, the software can be obtained and loaded into the safe 110, the device 112, the device 120 and/or the device 152, including obtaining the software via a disc medium or from any manner of network or distribution system, including from a server owned by the software creator or from a server not owned but used by the software creator. The software can be stored on a server for distribution over the Internet.

Couriers that adopt the new keyless courier entry into safes technology herein will move away from the need for physical keys to open safe doors. Customers can contract with safe manufacturers for annual contracts to maintain the digital opening application. This keyless feature will have the ability to register couriers, customers, safes and computing devices in the cloud. Safes can be added to a courier company in the cloud and registered couriers will have the ability to utilize the mobile computing device application to obtain a one-time security check code to open the safe door.

The mobile device may communicate with the safe manufacturers cloud to obtain data at least once every 24 hours, but communication need not be in real time with the keyless safe opening process.

Administration of the data and codes for keyless entry may occur on the safe manufacturers cloud. A new section in the cloud—Courier Assignment—may be developed for the process. Safes could be added to couriers in two ways. First under the courier assignment section of the cloud or a new cloud section can be created to allow couriers to manage safes they are authorized to enter. In some cases, only a safe manufacturer's administration will be able to assign a courier to a safe. The safe may be assigned to the courier by the safe's serial number and each safe may only be authorized to be opened by one courier person. The safe may not need to be enrolled in the cloud to be assigned to a courier.

Each courier can have a separate courier company log-in to the mobile and safe computing devices. The courier service can have the ability to add/edit/delete mobile computing device application users. The courier log-in can show each courier all assigned safes by serial number, location ID and Address. An excel download can be used by each courier to show which safes are in their application for which they are authorized to enter or open.

By providing keyless courier entry into safes, using the safe 110, the device 112 and/or the other components of the system 100 increases computer efficiency because these system components provide a quicker, automated and more accurate entry into the safe 110 or chamber 118. For example, providing keyless courier entry into safes using the safe 110, the device 112 and/or the other computing components of the system 100 allows easy computing device assignment and movement of keyless entry into safes allowing retailers to quickly change courier services. Using the computing components of the system 100 also moots the need for courier services and retailers currently to: pay for each physical key that is lost or broken, plus shipping costs; coordinate with the safe manufacturer and the courier to get a replacement key into the field; and perform the logistics involved with coordinating the courier physical key delivery, reconciling the missing deposits that were left in the unopened safe, or coordinating a new courier pick-up for the location.

In some cases, the courier actions can be performed by another party such as a merchant, safe owner, agent, and/or a computer controlled robot. The mobile computing device 152 may be a mobile phone, laptop, pad computer, automobile, drone, computer controlled robot, etc. The safe's serial number can be another piece of identifying information that individually identifies the safe with respect to all other safes of a safe manufacturer or all other safes. One or both of the selection for keyless entry to the safe may be automatically generated by proximity of the mobile device 152 to the safe device 112, such as by a proximity sensor of one or both devices able to sense the other device is with 5 or 10 feet.

Although shown implemented in a personal computer, the processes and apparatus may be implemented with any computing device. A computing device as used herein refers to any device with a processor, memory and a storage device that may execute instructions including, but not limited to, personal computers, server computers, computing tablets, set top boxes, video game systems, personal video recorders, telephones, personal digital assistants (PDAs), portable computers, and laptop computers. These computing devices may run an operating system, including variations of the Linux, Microsoft Windows, Symbian, and Apple Mac operating systems.

The techniques may be implemented with machine readable storage media in a storage device included with or otherwise coupled or attached to a computing device. That is, the software may be stored in electronic, machine readable media. These storage media include magnetic media such as hard disks, optical media such as compact disks (CD-ROM and CD-RW) and digital versatile disks (DVD and DVD±RW); flash memory cards; and other storage media. As used herein, a storage device is a device that allows for reading and/or writing to a storage medium. Storage devices include hard disk drives, DVD drives, flash memory devices, and others.

The device 120, safe device 112, the mobile device 152 and/or the other components of the system 100 may each include a keyless courier entry into safes unit and/or a computing unit. These units may be hardware, software, firmware, or a combination thereof. Additional and fewer units, modules or other arrangement of software, hardware and data structures may be used to achieve the processes and apparatuses described herein.

CLOSING COMMENTS

Throughout this description, the technologies described and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one technology are not intended to be excluded from a similar role in other technologies.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for keyless courier entry into a safe comprising:

receiving on a user interface (UI) from a courier by a safe computing device a safe computing device selection for keyless courier entry into the safe;

upon receiving the safe computing device selection for keyless courier entry, if the safe computing device selection is authenticated, generating and displaying on the UI to the courier by the safe computing device a factor code based on a known safe's serial number;

receiving on the UI from the courier by the safe computing device and authenticating a security check code input including a displayed security check code, wherein the displayed security check code is generated by a mobile computing device upon authentication of the factor code; and in response to receiving the security check code input and upon authenticating the security check code input, unlocking by the safe computing device a lock of the safe to allow the courier entry to the safe.

2. The method of claim 1 further comprising:

receiving on a touch screen from the courier by a mobile computing device and authenticating a courier mobile computing device login including a user identification and a user password;

receiving on the touch screen from the courier by the mobile computing device a mobile computing device selection for keyless courier entry into the safe;

receiving on the touch screen from the courier by the mobile computing device and authenticating the factor code input including the factor code; and in response to receiving the factor code input, and upon authenticating of the factor code, generating and displaying in the touch screen to the courier by the mobile computing device the displayed security check code to open the safe.

3. The method of claim 2, wherein authenticating the courier mobile computing device login includes authenticating an identification of the mobile computing device; and wherein the factor code input includes the safe serial number and is input either by reading a quick response (QR) code by the mobile computing device or receiving a manual input of the code by the mobile computing device.

4. The method of claim 2, wherein the mobile computing device has a mobile application including mobile mirror software that is the same as safe mirror software of a safe application of the safe;

wherein authenticating the courier mobile computing device login includes using a computer network or the internet to access a cloud server;

wherein the mobile computing device is not connected to a computer network or the Internet from logging into the safe to unlocking the chamber of the safe; and wherein the safe is not connected to a computer network or the Internet from logging into the safe to unlocking the chamber of the safe.

5. The method of claim 4, wherein the mobile mirror software and the safe mirror software each include a same listing of factor codes and security check codes in the factor code list and the security check code list; and further comprising:

periodically updating the mobile mirror software; and updating the mobile mirror software upon receiving and authenticating the courier mobile computing device login by the mobile computing device.

6. The method of claim 4, wherein the mobile mirror software and the safe mirror software include the same factor code list and security check code list.

7. The method of claim 2, wherein authenticating the courier mobile computing device login includes:

comparing the mobile device input user identification and password to a mobile device login list and authenticating the mobile computing device login if the mobile device input user identification and password are on the mobile device login list;

if the mobile computing device login is authenticated, generating by the mobile computing device an authenticated identification of the courier needed to generate a security check code; and if the mobile computing device login is not authenticated, generating by the mobile computing device and displaying on the touch screen a mobile computing device login error message.

8. The method of claim 2, wherein the mobile application generating the displayed security check code includes the mobile application comparing the input factor code to a security check list of authorized factor codes and corresponding security check codes;

if the input factor code is on the security check list, authenticating by the mobile application the input factor code and accessing from the security check list, the corresponding security check code of the factor code; and if the input factor code is not on the security check list, displaying by the mobile application on the touch screen an error message to the courier indicating that there is no corresponding security check code for the factor code for the safe's serial number that is authorized to be entered by the courier.

9. The method of claim 1, wherein the safe generating a factor code includes comparing the safe's known serial number to a factor code list having safe serial numbers and corresponding factor codes;

if the safe's serial number is on the factor code list, accessing from the factor code list, the corresponding factor code of the safe's serial number; and if the safe's serial number is not on the factor code list, displaying on the UI an error message to the courier indicating that there is no corresponding factor code for the safe's serial number that is authorized to be entered by the courier.

10. The method of claim 1, wherein authenticating the security check code input includes comparing the received displayed security check code to a security check code list having authorized security check codes for safes that are authorized to be entered by the courier;

if the input displayed security check code is on the security check list, authenticating the input displayed security check code and displaying on the UI that the input displayed security check code is authenticated; and if the input displayed security check code is not on the security check list, displaying on the UI an error message to the courier indicating that the input displayed security check code is not authenticated for the safe's serial number to be entered by the courier.

11. A non-volatile machine readable medium of a safe computing device storing a program having instructions which when executed by a processor will cause the processor to perform keyless courier entry into a safe, the instructions of the program for causing:

a safe computing device to receive on a user interface (UI) from a courier a safe computing device selection for keyless courier entry into the safe;

upon receiving the safe computing device selection for keyless courier entry, if the safe computing device selection is authenticated, the safe computing device to generate and display on the UI to the courier a factor code based on a known safe's serial number;

the safe computing device to receive on the UI from the courier and authenticating a security check code input including a displayed security check code, wherein the displayed security check code is generated by a mobile computing device upon authentication of the factor code; and in response to receiving the security check code input and upon authenticating the security check code input, the safe computing device to unlock a lock of the safe to allow the courier entry to the safe.

12. The medium of claim 11, wherein the factor code input includes the safe serial number and is input either by the mobile device reading a quick response (QR) code or receiving a manual input of the code.

13. The medium of claim 11, wherein the safe computing device generating a factor code includes the safe computing device comparing the safe's known serial number to a factor code list having safe serial numbers and corresponding factor codes;

if the safe's serial number is on the factor code list, the safe computing device accessing from the factor code list, the corresponding factor code of the safe's serial number; and if the safe's serial number is not on the factor code list, the safe computing device displaying on the UI an error message to the courier indicating that there is no corresponding factor code for the safe's serial number that is authorized to be entered by the courier.

14. The method of claim 11, wherein the safe computing device authenticating the security check code input includes the safe computing device comparing the received displayed security check code to a security check code list having authorized security check codes for safes that are authorized to be entered by the courier;

if the input displayed security check code is on the security check list, the safe computing device authenticating the input displayed security check code and displaying on the UI that the input displayed security check code is authenticated; and if the input displayed security check code is not on the security check list, the safe computing device displaying on the UI an error message to the courier indicating that the input displayed security check code is not authenticated for the safe's serial number to be entered by the courier.

15. A non-volatile machine readable medium of a mobile computing device storing a program having instructions which when executed by a processor will cause the processor to perform keyless courier entry into a safe, the instructions of the program for causing:

the mobile computing device to receive on a touch screen from a courier and authenticating a courier mobile computing device login including a user identification and a user password;

the mobile computing device to receive on the touch screen from the courier a mobile computing device selection for keyless courier entry into the safe;

the mobile computing device to receive on the touch screen from the courier and authenticating a factor code input including the factor code; and in response to receiving the factor code input, and upon authenticating of the factor code, the mobile computing device to generate and display in the touch screen to the courier a security check code to open the safe, wherein a safe computing device authentication of the security check code causes the safe computing device to unlock a lock of the safe to allow the courier entry to the safe.

16. The medium of claim 15, wherein the mobile computing device authenticating the courier mobile computing device login includes authenticating an identification of the mobile computing device; and wherein the mobile computing device receiving the factor code includes input of the safe serial number by one of reading a barcode or manual input by the courier.

17. The medium of claim 15, wherein authenticating the courier mobile computing device login includes:

comparing the mobile device input user identification and password to a mobile device login list and authenticating the mobile computing device login if the mobile device input user identification and password are on the mobile device login list;

if the mobile computing device login is authenticated, the mobile computing device generating an authenticated identification of the courier needed to generate a security check code; and if the mobile computing device login is not authenticated, the mobile computing device generating and displaying on the touch screen a mobile computing device login error message; and wherein the mobile application generating the security check code includes the mobile application comparing the input factor code to a security check list of authorized factor codes and corresponding security check codes;

if the input factor code is on the security check list, the mobile application authenticating the input factor code and accessing from the security check list, the corresponding security check code of the factor code; and if the input factor code is not on the security check list, the mobile application displaying on the touch screen an error message to the courier indicating that there is no corresponding security check code for the factor code for the safe's serial number that is authorized to be entered by the courier.

18. A system for keyless courier entry into a safe comprising:

the safe having:

a secure chamber for receiving and a lock for securing items;

a safe computing device coupled to the lock for generating a factor code including by:

receiving and authenticating a safe login from a merchant;

receiving a safe selection from a courier for keyless courier entry into the safe;

generating and displaying the factor code in response to authenticating the courier and receiving the selection;

receiving from the courier and authenticating a security check code, wherein the security check code is generated by a mobile computing device upon authentication of the factor code; and opening the lock upon authenticating the security check code, wherein during generating the factor code, the safe computing device is not connected to a computer network or the Internet.

19. The system of claim 18, further comprising:

the mobile computing device for generating the security check code including by:

receiving and authenticating the mobile computing device login from the courier;

receiving a mobile computing device selection from the courier for keyless courier entry into the safe;

receiving and authenticating a factor code input by the courier; and in response to authenticating the factor code generating and displaying the security check code for entry into the safe by the courier, wherein during generating the security check code, the mobile computing device is not connected to a computer network or the Internet.

20. The system of claim 19, wherein the mobile computing device authenticating the courier mobile computing device login includes authenticating an identification of the mobile computing device; and wherein the factor code input includes the safe serial number and is input either by the mobile device reading a quick response (QR) code or receiving a manual input of the code.

21. The system of claim 19, wherein the mobile computing device has a mobile application including mobile mirror software that is the same as safe mirrors mirror software of a safe application of the safe;

wherein the mobile computing device is connected to a computer network or a Internet during mobile device courier login;

wherein the mobile computing device is not connected to a computer network or the Internet from logging into the safe to unlocking the chamber of the safe; and wherein the safe is not connected to a computer network or the Internet from logging into the safe to unlocking the chamber of the safe.

22. The system of claim 21, wherein the mobile mirror software and the safe mirror software each include a same listing of factor codes and security check codes in the factor code list and the security check code list; and further comprising:

periodically updating the mobile mirror software; and updating the mobile mirror software upon the mobile computing device receiving and authenticating the mobile computing device login.

23. The system of claim 21, wherein the mobile mirror software and the safe mirror software include the same factor code list and security check code list.

* * * * *